US009196990B2

(12) United States Patent
Koebrich et al.

(10) Patent No.: US 9,196,990 B2
(45) Date of Patent: Nov. 24, 2015

(54) APPARATUSES AND METHODS FOR A PLUG CONNECTOR

(71) Applicant: E.G.O. Elektro-Geraetebau GmbH, Oberderdingen (DE)

(72) Inventors: Holger Koebrich, Kraichtal (DE); Uwe Koegel, Kuernbach (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 190 days.

(21) Appl. No.: 14/095,111

(22) Filed: Dec. 3, 2013

(65) Prior Publication Data

US 2014/0154930 A1 Jun. 5, 2014

(30) Foreign Application Priority Data

Dec. 5, 2012 (DE) ..... 10 2012 222 364

(51) Int. Cl.

| | |
|---|---|
| ***H01R 12/00*** | (2006.01) |
| ***H01R 13/04*** | (2006.01) |
| ***H01R 12/57*** | (2011.01) |
| ***H01R 12/70*** | (2011.01) |
| ***H01R 12/71*** | (2011.01) |

(52) U.S. Cl.

CPC ..... *H01R 13/04* (2013.01); *H01R 12/57* (2013.01); *H01R 12/7082* (2013.01); *H01R 12/716* (2013.01)

(58) Field of Classification Search

CPC ..... H01R 23/725; H01R 12/57
USPC ..... 439/78, 83, 74, 554, 855, 516, 811, 709
See application file for complete search history.

(56) References Cited

U.S. PATENT DOCUMENTS

| | | | | |
|---|---|---|---|---|
| 5,057,027 | A | 10/1991 | Yamada et al. | |
| 5,879,200 | A * | 3/1999 | Sugie | 439/733.1 |
| 6,152,782 | A * | 11/2000 | Volkert et al. | 439/733.1 |
| 2004/0229519 | A1 * | 11/2004 | Lappohn | 439/733.1 |
| 2005/0142907 | A1 | 6/2005 | Myer et al. | |
| 2006/0089036 | A1 | 4/2006 | Takai et al. | |
| 2007/0175741 | A1 | 8/2007 | Fukazawa | |
| 2008/0032536 | A1 | 2/2008 | Lappoehn | |
| 2009/0068860 | A1 | 3/2009 | Suzuki et al. | |
| 2010/0081312 | A1 | 4/2010 | Kodaira | |
| 2010/0173518 | A1 | 7/2010 | Suzuki et al. | |
| 2011/0201217 | A1 | 8/2011 | Koyama et al. | |

FOREIGN PATENT DOCUMENTS

| | | | |
|---|---|---|---|
| DE | 10021512 | A1 | 11/2001 |
| DE | 10318524 | A1 | 12/2003 |
| DE | 102007013881 | A1 | 10/2008 |
| EP | 0448382 | A1 | 9/1991 |
| EP | 0538029 | A2 | 4/1993 |

* cited by examiner

*Primary Examiner* — Phuongchi T Nguyen
(74) *Attorney, Agent, or Firm* — Alston & Bird LLP

(57) ABSTRACT

A plug connector has a housing and a plurality of metallic plug connections in the housing together with a plurality of contact feet which project from the bottom face of the housing in order to make electrical contact and be mechanically fixed to a support of a heating apparatus which is electrically connected to the plug connector. A contact foot has a U-shaped foot end with two limbs and with a cutout in-between, an upper limb merging with the contact foot, and a lower limb being provided on that side which faces away from the housing.

17 Claims, 2 Drawing Sheets

APPARATUSES AND METHODS FOR A PLUG CONNECTOR

CROSS-REFERENCE TO RELATED APPLICATIONS

This application claims priority to German Application No. 10 2012 222 364.9, filed on Dec. 5, 2012, the contents of which are hereby incorporated herein in its entirety by reference.

TECHNOLOGICAL FIELD

The invention relates to a plug connector having a housing and plug connections in the housing, and also to an apparatus which is provided with a plug connector of this kind.

BACKGROUND

In general, a corresponding plug connector is known, for example, from DE 102007013881 A1. A plug connector on a heating apparatus is known from DE 10021512 A1, it being possible for the support to be of flat or tubular design and therefore to have a convex surface.

BRIEF SUMMARY

The invention is based on the problem of providing a plug connector of the kind described in the introductory part and also an apparatus which is provided with a plug connector of this kind, with which plug connector and apparatus problems of the prior art can be avoided and it is possible, in particular, to fix a plug connector simply and permanently to a corresponding apparatus for the purpose of electrical connection of the apparatus.

This problem is solved by a plug connector and also by an apparatus. Advantageous and also preferred refinements of the invention are the subject matter of the further claims and will be described in greater detail in the text which follows. In the explanation, some of the features will be described only for the plug connector or only for the apparatus. However, irrespective of this, they should be independently applicable both to the plug connector and also to the apparatus. The wording of the claims is incorporated in the description by express reference.

Provision is made for the plug connector to have a housing and a plurality of plug connections in the housing, the plug connections advantageously being metallic, particularly advantageously being stamped or worked out of a metal sheet. The plug connector has a plurality of contact feet which are each connected to the plug connections or are integrally formed with the plug connections and protrude or project from the bottom face of the housing. In this case, the contact feet can particularly advantageously protrude from the housing toward the side or laterally beyond the housing. The contact feet serve to make electrical contact and to mechanically fix the plug connector to the apparatus or to a support of the apparatus.

According to the invention, a contact foot has a U-shaped foot end with two limbs, it also being possible for a hook shape to be provided. The two limbs are advantageously approximately parallel to one another. An upper limb merges with the contact foot or the contact foot merges with the upper limb. This is followed by a bend of the U- or hook shape and then a lower limb, with the result that a cutout is provided between the two limbs. The lower limb is provided on that side which faces away from the housing or in the direction of the abovementioned support. Therefore, the lower limb of the contact foot is substantially connected to the support or to the apparatus. As a result, it is possible for the housing of the plug connector to be at a somewhat larger distance from the support or the apparatus, this being advantageous when the apparatus is a heating apparatus or when the support is at high temperatures, in particular also during firm soldering or welding. Furthermore, a certain elasticity and/or spring action is achieved both by the somewhat elongate shape of the contact feet and also primarily by the design of the foot end with the U- or hook shape and fixing by way of the lower limb of the foot end. The spring action can be influenced by suitable material selection and dimensioning. The spring action is advantageously such that, given the normal forces when plugging a plug onto the plug connector or also when removing the plug, a short spring travel of at most 1 mm or 2 mm is given or will be exploited. However, a stable and defined arrangement and orientation of the plug connector is still provided at the same time.

The contact feet advantageously run substantially transverse to the plug connections or the intended plugging direction thereof. It is therefore also possible for the contact feet to protrude laterally beneath the housing and to be visible and accessible for fixing or for firm soldering or firm welding. Furthermore, a certain spring action is also possible in this way, even if it is relatively small. In order to increase the spring action, the contact feet would have to be made longer, but this would in turn require more space than is desired.

Advantageously, not only does the contact foot generally project laterally beyond the housing or protrude from the bottom face of the housing, but rather primarily the abovementioned foot end with the two limbs and the cutout in-between does so. The entire lower limb should particularly advantageously project laterally since fixing to the support is performed by way of the lower limb.

In a refinement of the invention, the length of the lower limb is at least 100% to 300% of the maximum height of the cutout or of the intermediate space in the foot end. A maximum spring travel can be set by means of this height. Furthermore, the height should, of course, not be too large either, so that the overall height of the plug connector above the support is not excessive. Equally, the lower limb should have a certain length, in particular also for good contact-making and fixing to the support. At the same time, the lower limb should also not be excessively long, so that it particularly advantageously does not extend beneath the housing and at the same time the entire contact foot does not project too far laterally from the housing, as a result of which problems in respect of installation space can be avoided.

In a further refinement of the invention, the cutout or a corresponding intermediate space in the foot end between the two limbs faces inward, that is to say virtually toward a space or into a space in the bottom face of the housing. The foot end therefore faces outward by way of the bend. The result is a good ratio between the width of the entire plug connector, the length of the contact feet or of the foot end and spring action and also length of the thermal travel within the contact foot from the support into the plug connector.

In a further refinement of the invention, the cutout or a corresponding free intermediate space can have a height which is between 50% and 150% of the height of the contact foot in its region close to the foot end. A contact foot is advantageously composed of sheet metal with a thickness of between 0.3 mm and 2 mm, particularly advantageously of from 0.5 mm to 1 mm. The contact foot therefore has a rectangular cross section, the intention being for the height of the contact foot at a point close to the foot end to be greater than its thickness or a material thickness.

In a yet further refinement of the invention, the cutout or the corresponding intermediate space has a constant height over the majority of the length. This is true, in particular, for at least 90% to 95% of the length of the contact foot, specifically up to a point close to the foot end or even up to a point at the U-shaped bend in the foot end.

The cutout or the corresponding intermediate space can be tapered in the direction of the bend, at least at the outer end. Therefore, a kind of V-shaped tapered portion can be provided. An angle between the longitudinal axis of the upper limb and the longitudinal axis of the lower limb or in the V-shape can be between 5° and 45°, advantageously between 15° and 30° in this case.

In a refinement of the invention, a rounded, enlarged opening can be provided in the cutout or in the corresponding intermediate space in the direction of the bend. As a result, the spring action can be improved. The opening can advantageously be of approximately circular design or in the form of part of a circle. A diameter or a clear height of the cutout or of the intermediate space can be greater than the maximum height of the opening.

In a further advantageous refinement of the invention, it is possible for a bottom face of the lower limb to be inclined, particularly advantageously inward toward the housing or toward a centre longitudinal axis of the housing. A reference plane for the incline can also be formed such that it is touched by all of the contact feet or is formed by the contact feet, so that the bottom face of the one lower limb, preferably a plurality of bottom faces, are equally inclined in comparison to this plane. An angle of this kind of an incline can be between 5° and 30°, preferably between 15° and 25°. This is advantageous when the support on which the plug connector is intended to be fixed, is curved, specifically is either convex or concave. If, advantageously, a plurality of contact feet project from the plug connector, specifically on opposite sides of the housing, and then all of the contact feet are equally inclined at their bottom face on one side of the housing and the contact feet on the opposite side are accordingly inclined, all of the contact feet can bear equally well on the support by way of their bottom faces. As a result, a somewhat constant solder gap can be achieved. In order to improve the solder gap, the bottom faces of the contact feet can even be cut out in a bent manner so as to correspond to a curvature of the support. Furthermore, less solder tin is required with an adapted shape of this kind.

Furthermore, owing to a bend of this kind in the foot end, heating of the plug connector by means of the contact feet when the lower limb is firmly soldered or firmly welded is reduced. Furthermore, the firmly soldered or firmly welded contact foot is cooled to a lesser extent in this case, and therefore shorter soldering times are possible.

In a further refinement of the invention, a radius or a rounded portion can be provided on a bottom face of the lower limb of the foot end at the transition to the outwardly facing bend, specifically advantageously at the widest external point of the outer limb. A radius of this kind simplifies production of the contact foot and likewise allows an optimized solder gap.

Furthermore, it is possible for an abovementioned radius or an abovementioned rounded portion to be formed on a projection which projects beyond the rest of the bottom face of the lower limb. A projection of this kind has the advantage that a defined solder gap is produced when the contact foot is fixed to a flat support, the major portion of the bottom face of the lower limb being at a short distance from the support. An abovementioned radius can be in the range of from 0.2 mm to 2 mm, advantageously of from 0.4 mm to 1 mm. The abovementioned projection can be from 0.1 mm to 1 mm, advantageously from 0.3 mm to 0.7 mm, as seen with respect to a flat plane.

In a further advantageous refinement of the invention, a recess or depression, that is to say a reduction in the material thickness, is provided in a contact foot, in particular in the region of the foot end or in front of an abovementioned bend, that is to say just in front of the upper limb of the foot end or in the upper limb of the foot end. It is considered to be advantageous if this recess or depression is made laterally. It can be provided, for example, by stamping or notching. As a result, flexibility can be achieved in respect of the fixing of the contact feet because the material is weakened and therefore has a greater yielding capacity in this case. Therefore, forces which act on the plug connector in the plugging direction can additionally be held better and therefore an additional spring action is achieved.

Preferably, at least one contact foot protrudes in its longitudinal direction over a lateral side of the housing. The contact foot can protrude over the lateral side of the housing with the lower limb and the cutout. This means that the contact foot protrudes preferably from the underside of the housing and from the lateral sides. All the contact foots may protrude in that way for easier fixing.

At least two contact foots are provided on opposing lateral sides of the housing, wherein they have opposing longitudinal directions. They need not absolutely be in one direct line, but can be only parallel. Preferably, all the contact foots are parallel to each other.

The apparatus according to the invention advantageously has an above-described plug connector, particularly advantageously only a single one. Provision can be made for all of the foot ends, under certain circumstances even a majority of the contact feet which project out of the housing, to be of similar or identical design in the plug connector. In this case, the contact feet project out of the housing advantageously on two opposite sides by way of the foot ends.

These and further features can be gathered from the claims, the description and the drawings, it being possible for the individual features to be realized in each case in their own right, or jointly in the form of subcombinations, in an embodiment of the invention and in other areas and to represent advantageous embodiments which can be protected in their own right. The subdivision of the application into individual sections and sub-headings does not restrict the statements made under them in terms of their general validity.

BRIEF DESCRIPTION OF THE SEVERAL VIEWS OF THE DRAWINGS

Exemplary embodiments of the invention are schematically illustrated in the drawings and will be explained in greater detail below. In the drawings.

DETAILED DESCRIPTION

Figure 1:
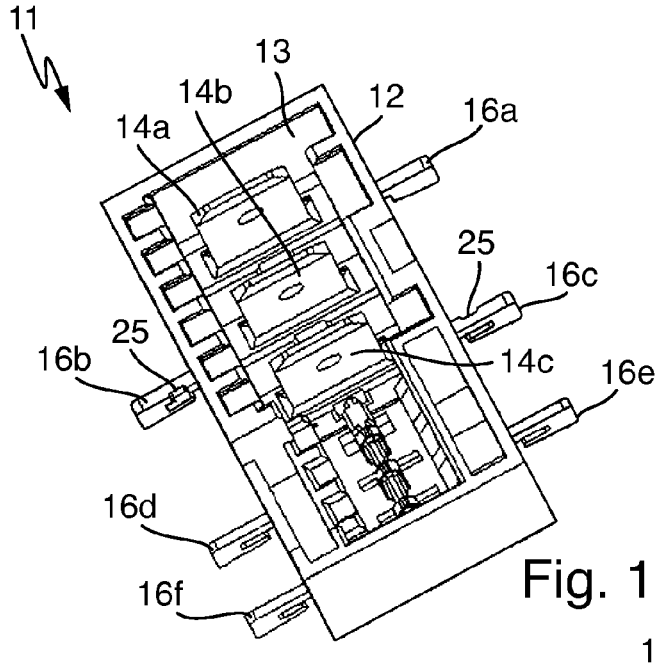
FIG. 1 shows an oblique plan view of a plug connector according to the invention.

FIG. 1 shows a plug connector 11 according to the invention in an oblique plan view. The plug connector has, as is known from the prior art which is cited in the introductory part, a housing 12 having an interior space 13 in which upwardly projecting plug connections 14*a* to 14*c* are arranged. This and primarily the design of the interior space 13 are known to a person skilled in the art per se and do not need to be explained in any more detail here, neither do a coding which is provided on the inner face by projections and recesses or division of the interior space into two.

Figure 2:
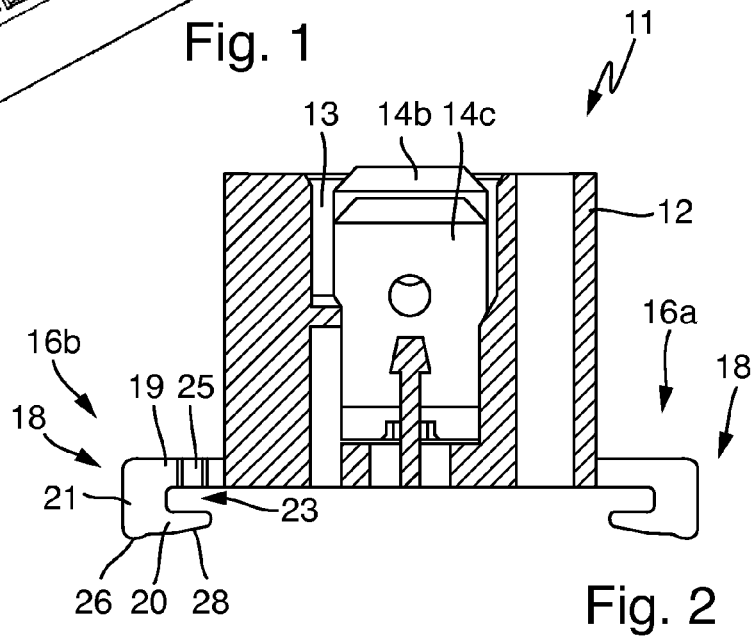
FIG. 2 shows an enlarged sectional illustration through the plug connector from FIG. 1, FIGS. 3 and 4 show two modifications of designs of contact feet for the plug connector with cutouts of different design.

As is clear primarily also from FIG. 2, contact feet 16*a* to 16*f* project from the bottom of the housing 12 or from the bottom of the plug connector 11. These contact feet 16 are each of identical design per se, as is clear from the enlarged illustration in FIGS. 3 and 4, and they are integrally connected to the plug connections 14 or at least partially merge with the plug connections, in particular with the rear interior space 13 in the plug connections 14*a* to 14*c*. The front three contact feet 16*d* to 16*f* have plug connections of different design but are not discussed in any detail here.

The contact feet 16, together with the plug connections 14, are integrated in the housing 12, specifically either pressed in after the housing is produced, advantageously from plastic, or else directly jointly injection-moulded. The contact feet 16 protrude laterally from the bottom of the housing 12. They could also protrude from the bottom face of the housing.

Figure 3:
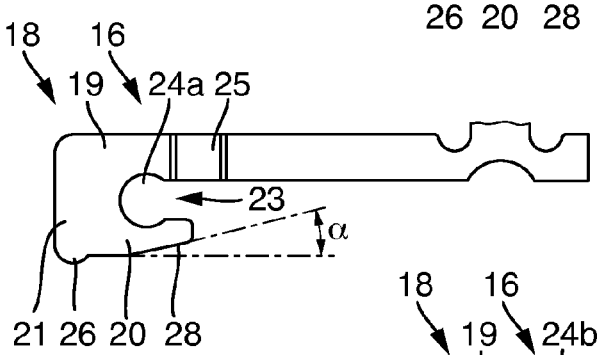
Figure 4:
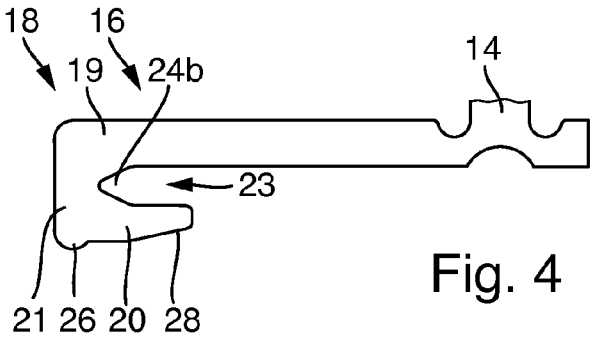

According to FIGS. 3 and 4, a contact foot 16 has an elongate profile which leads away from the plug connection 14 in the direction of a foot end 18. An upper limb 19 is now provided at the foot end 18, the upper limb virtually forming the extension of the upper contact foot. The upper limb 19 has a bend 21 to a lower limb 20. In this case, the upper limb 19 and the lower limb 20 run approximately parallel. In this case, the region of the bend 21 is relatively broad, and therefore the spring action mentioned above is only very slight or not present at all. However, lateral forces can still be absorbed considerably better as a result. The reduced thermal conduction is also maintained.

A stamped portion 25 is provided in the contact foot 16 on the upper limb 19 or at least at the transition to the upper limb, the stamped portion being made laterally, as shown in FIG. 1. The stamped portion 25 extends over a width in the region of the height of the contact foot 16 and its depth can be 10% to 30% or 40% of the thickness of the material of the contact foot 16. The stamped portion should primarily produce a thinning in the material and therefore a certain weakening, as a result of which the abovementioned active forces can be better cushioned in the horizontal and vertical direction on the plug connector 11. Furthermore, the entry of heat into the plug connector 11 during firm soldering or firm welding is once again reduced as a result, in a similar way to by the bend in the foot end 18.

A projection 26 is provided on the lower limb 20 to the left of the bend 21. The projection has a substantially round radius which can amount to the abovementioned 0.4 mm to 1 mm. In this case, the projection 26 projects downward beyond the bottom face of the lower limb 20. The lower limb 20 has an incline 28 to the right in the direction of its free end. The angle a of the incline in relation to the bottom face or to a plane on which all of the bottom faces of the contact feet 16 lie is, for example, 15° and lies within the abovementioned region. However, this can also vary depending on the intended use of the plug connector 11

In FIG. 2, a cutout 23 is provided in the foot end 18 with a constant height. A modification of this can be found in FIG. 3 where an enlarged opening 24*a* is still provided in the cutout 23, the opening basically being in the form of part of a circle in this case. The radius of this opening 24*a* is approximately 0.8 mm to 2 mm. This serves, similarly to the stamped portion 25, to better cushion forces acting on the plug connector 11 in the assembled state and to reduce thermal conduction from the lower limb 20 to the plug connector 11 during soldering.

In a yet further modification according to FIG. 4, the cutout 23 is provided with an opening 24*b* which is tapered in the manner of a wedge in a contact foot 16. Whereas the round opening 24*a* according to FIG. 3 acts primarily upward in the upper limb 19 or the elongate region of the contact foot 16, the wedge-shaped cutout 24*b* extends to the left into the bend 21. However, the wedge-shaped cutout likewise serves to improve the spring action and to reduce the thermal conductivity.

Figure 5:
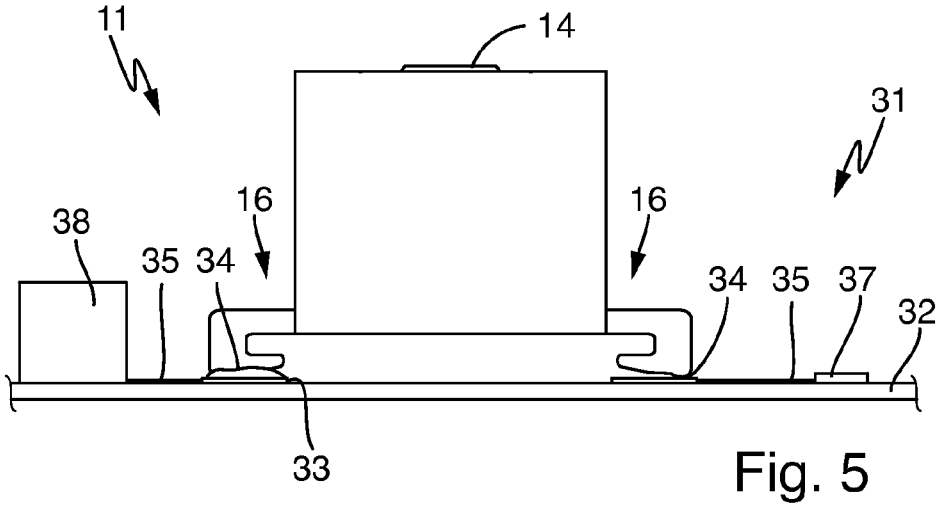
FIG. 5 shows a heating apparatus according to the invention with a flat support on which a plug connector and a heating device are arranged.

FIG. 5 shows a heating apparatus 31 according to the invention with a flat support 32 and contact areas 33 on which, illustrated on the left-hand side, the plug connector 11 is fitted or firmly soldered by way of its contact feet 16 by means of solder tin 34. It is clear from this that soldering is very easy because, owing to the projection 26 on the lower limb 20, the solder gap between the rest of the bottom face of the lower limb 20 and the contact area 33 is precisely prespecified for such flat supports 32.

The contact areas 33 are connected by means of conductor paths 35 which make contact with a heating device 37 in the right-hand region. As described, for example, in DE 10021512 A1 which is cited in the introductory part, this heating device 37 can have a plurality of heating conductors, preferably designed using thick-film technology, which are fitted directly on the support 32. In the left-hand region, the conductor path 35 leads to a controller 38 as a separate electrical or electronic component.

Figure 6:
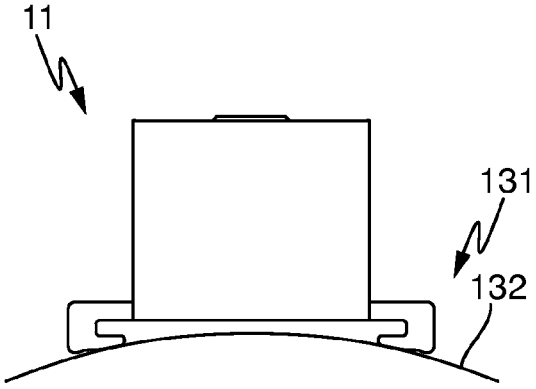
FIGS. 6 and 7 show modifications of a heating apparatus similar to FIG. 5 with supports having different curvatures.

FIG. 6 shows a modification of a heating apparatus 131, the support 132 of the heating apparatus having a relatively severe curvature. In this case, the curvature of the support 132 is such that the inclines 28 on the lower limbs 20 of the plug connector 11 run approximately with their centre region tangential to the surface of the support 132. Therefore, a relatively narrow solder gap which is provided over a certain length is also provided here for the purpose of effective soldering to contact areas (not illustrated here) on the support 132.

Figure 7:
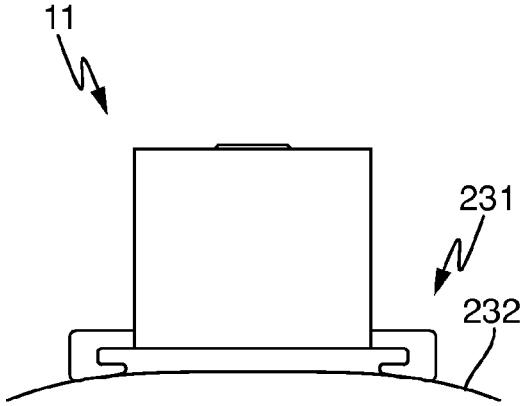

FIG. 7 shows a yet further modification of a heating apparatus 231 with a curved support 232 which, however, is considerably less curved than in FIG. 6. In this case, the curvature is such that the projection 26 on the lower limbs 20 of the plug connector 11 bears against the support, as do the corners of the transition of the straight region of the lower limb 20 into the incline 28. Therefore, an advantageous solder gap is also provided here, even if this is defined by a plurality of bearing points between which the solder gap varies but has a respectively advantageous height.

That which is claimed:

1. A plug connector comprising:

a housing;

a plurality of metallic plug connections in said housing; and a plurality of contact feet which project from a bottom face of said housing in order to make electrical contact and to be mechanically fixed to a support of an apparatus which is electrically connected to said plug connector, wherein one contact foot has a U-shaped foot end with an upper limb and a lower limb, said upper limb merging with said contact foot, with a cutout between said upper limb and said contact foot, and said lower limb being provided on a side of said contact foot facing away from said housing, wherein a bottom face of said lower limb is inclined inward toward said housing and toward a centre longitudinal axis of said housing, and wherein said bottom face of said lower limb is inclined inward toward said housing and toward a centre longitudinal axis of said housing at an angle in relation to a plane which touches all of said contact feet and is formed by said contact feet, said angle being between 5° and 30°.

2. The plug connector according to claim 1, wherein a length of said lower limb is at least 100% to 300% of a maximum height of said cutout or of an intermediate space in said foot end.

3. The plug connector according to claim 1, wherein said cutout in said foot end faces inward between the limbs into a space in said bottom face of said housing in such a way that said foot end faces outward with a bend.

4. The plug connector according to claim 1, wherein said cutout has a height of between 50% and 150% of a height of said contact foot up to a point in front of said foot end.

5. The plug connector according to claim 1, wherein said cutout has a constant height over a major part of its length.

6. The plug connector according to claim 1, wherein said cutout is tapered.

7. The plug connector according to claim 1, wherein a rounded enlarged opening is provided in said cutout in a direction of said bend, a diameter or clear height of said opening being greater than a maximum height of said cutout.

8. The plug connector according to claim 1, wherein at least two contact feet are provided on opposing lateral sides of said housing, wherein said at least two contact feet have opposing longitudinal directions.

9. The plug connector according to claim 1, wherein a radius or a rounded portion is provided on a bottom face of the lower limb at a transition to an outwardly facing bend.

10. The plug connector according to claim 9, wherein said radius or said rounded portion is formed on a projection which projects beyond a rest of said bottom face of said lower limb.

11. The plug connector according to claim 1, wherein a lateral recess or a depression for increasing flexibility in respect of a fixing of said contact feet is provided in one said contact foot.

12. The plug connector according to claim 11, wherein said lateral recess or said depression is provided in said contact foot in a region of said foot end just in front of said upper limb of said foot end.

13. The plug connector according to claim 1, wherein at least one said contact foot protrudes in its longitudinal direction over a lateral side of said housing.

14. The plug connector according to claim 13, wherein said contact foot protrudes over said lateral side of said housing with said lower limb and said cutout.

15. An apparatus for making electrical contact by way of a plug connection, the apparatus comprising:

a plug connector comprising:

a housing;

a plurality of metallic plug connections in said housing; and a plurality of contact feet which project from a bottom face of said housing in order to make electrical contact and to be mechanically fixed to a support of an apparatus which is electrically connected to said plug connector, wherein one contact foot has a U-shaped foot end with an upper limb and a lower limb, said upper limb merging with said contact foot, with a cutout between said upper limb and said contact foot, and said lower limb being provided on a side of said contact foot facing away from said housing, wherein a bottom face of said lower limb is inclined inward toward said housing and toward a centre longitudinal axis of said housing, wherein said bottom face of said lower limb is inclined inward toward said housing and toward a centre longitudinal axis of said housing at an angle in relation to a plane which touches all of said contact feet and is formed by said contact feet, said angle being between 5° and 30°, and wherein said contact feet of said plug connector or of said plug connections bearing against contact areas on a support of said apparatus, wherein a contact surface of said contact areas is planar or convexly curved.

16. The apparatus according to claim 15, wherein the apparatus comprises a heating apparatus and comprises at least one heating device which is fitted on said support.

17. The apparatus according to claim 15, wherein said plug connector is firmly soldered to said contact areas of said support by way of said contact feet or said foot ends.

* * * * *